United States Patent [19]

Pritchard

[11] Patent Number: 4,589,321

[45] Date of Patent: May 20, 1986

[54] STRING ATTACHMENT MEANS FOR A TUNING MACHINE

[75] Inventor: Eric K. Pritchard, Bowie, Md.

[73] Assignee: Paul Reed Smith, Annapolis, Md.

[21] Appl. No.: 624,341

[22] Filed: Jun. 25, 1984

[51] Int. Cl.[4] ..... G10D 3/12

[52] U.S. Cl. ..... 84/297 R; 84/298; 84/304

[58] Field of Search ..... 84/200–208, 84/297 R, 304–306, 298–299, 307

[56] References Cited

U.S. PATENT DOCUMENTS

| | | | |
|---|---|---|---|
| 331,825 | 12/1885 | Rogers | 84/200 |
| 631,118 | 8/1899 | Martin . | |
| 1,295,215 | 2/1919 | Schermerhorn . | |
| 1,732,172 | 10/1929 | Smith . | |
| 1,811,738 | 6/1931 | Williams | 84/297 R |
| 2,232,453 | 2/1941 | Harvey | 84/304 |
| 2,557,877 | 6/1951 | Kluson | 84/304 |
| 3,963,305 | 6/1976 | Doktor et al. . | |
| 4,323,725 | 4/1982 | Müller . | |
| 4,425,862 | 1/1984 | Hirsch et al. . | |

*Primary Examiner*—Lawrence R. Franklin
*Attorney, Agent, or Firm*—Barnes & Thornburg

[57] ABSTRACT

A string attachment device having a sleeve encompassing a cam, an aperture in the sleeve to position a string therebetween and means to rotate the sleeve and cam relative to each other to grasp the string therebetween.

15 Claims, 7 Drawing Figures

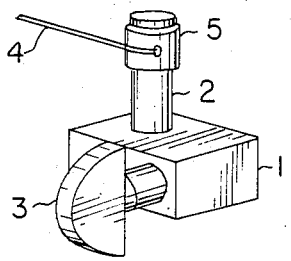
FIG. 1
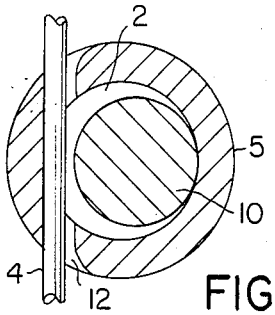
FIG. 2
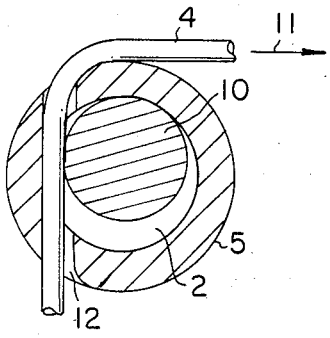
FIG. 3
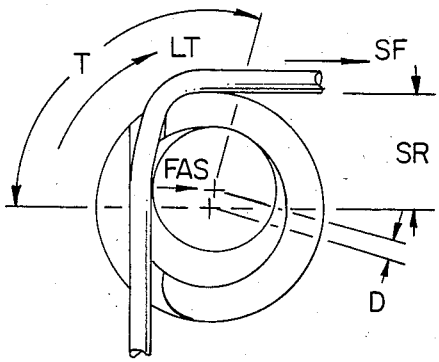
FIG. 4
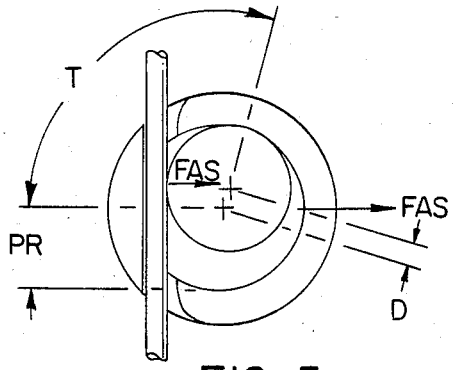
FIG. 5
FIG. 6
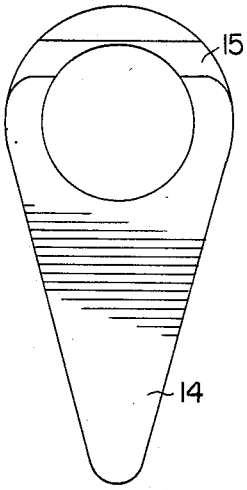
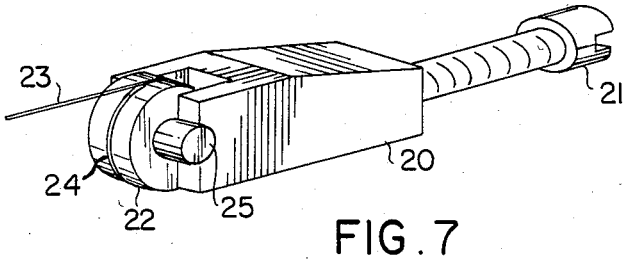
FIG. 7

STRING ATTACHMENT MEANS FOR A TUNING MACHINE

BACKGROUND OF THE INVENTION

The invention pertains to stringed musical instruments and to means for attaching and tensioning strings to said instruments in particular. This invention also relates to mechanical cam locking mechanisms for wire or cable. The stringed instrument art is typified by string attachment means that require numerous turns of the string to secure the string to a tuning device. The other end of the string is typically secured by a ball that is captured by an appropriate reciever in the instrument.

A U.S. patent entitled "A String Suspension System for a Stringed Musical Instrument" by Paul Reed Smith, U.S. Pat. No. 4,453,443, discloses that multiple turns of the string around the tuning machine is detrimental to the maintenance of string pitch. Smith further discloses a string clamping technique that minimizes the string rap to less than a single turn. Unfortunately, this method requires a tool to tighten the clamp.

U.S. Pat. No. 2,557,877 to Kluson discloses a tuning machine which rotates a tuning peg. The peg has a sleeve around it which preferrably rotates. Both the peg and the sleeve have a cross hole or aperture that line up for the insertion of the string. When the peg is rotated to tighten the string, the sleeve tends to not rotate since it is being restrained by a bend in the string. As a consequence, the cross holes go out of line and clamps the string. Unfortunately, the structure is not self locking and tends to cut the string.

The Floyd Rose U.S. Pat. No. 4,171,661, describes a technique for fixing the pitch of the instrument by clamping the strings at the bridge and the nut at the end of the neck. Although the Rose design is effective in maintaining the pitch of the instrument, it requires tools to loosen various clamps.

OBJECTS OF THIS INVENTION

The first object of this invention is a tuning machine having a tuning peg and sleeve structured to clamp the string without the use of tools and without the tendancy to cut the string.

A second object of this invention is a bridge saddle that incorporates a clamping device to use strings without ball ends.

BRIEF DESCRIPTION OF THE DRAWINGS

FIG. 1 is a perspective view of the tuning peg.

FIG. 2 is a cross-sectional view of FIG. 1 with the string insert position of the sleeve relative to the tuning peg.

FIG. 3 is a cross-sectional view of the string clamp position of the sleeve relative to the tuning peg.

FIG. 4 is the force analysis diagram of the improved tuning peg with string tension applied.

FIG. 5 is the force analysis diagram of the improved tuning peg in the self lock condition.

FIG. 6 is the tear drop sleeve embodiment of the tuning peg improvement.

FIG. 7 is a perspective view of the bridge saddle.

DISCLOSURE

The tuning peg embodiment of the present invention is a modification of the tuning machine disclosure of J. B. Thompson, U.S. Pat. No. 3,431,807. The Thompson tuning machine has a stylized knob that drives a worm via a shaft. The worm turns a worm gear which is attached to the tuning peg. The tuning peg tensions the string of the musical instrument. Unfortunately, this tuning peg requires multiple turns of the string wrapped around it to properly afix the string.

FIG. 1 shows an improved tuning machine 1 having a tuning peg 2 and tuning adjustment knob 3. The musician rotates the knob 3 to rotate peg 2 that consequently tightens or loosens string 4. This tuning machine incorporates a sleeve 5 which in cooperation with tuning peg 2 clamps the string 4.

FIG. 2 shows a cross section of the tuning peg 2 and the sleeve 5 in the string inserting position. In this region the tuning peg is turned down eccentrically to produce cam cross section 10. When the cam is in this position the string 4 has clearance to be inserted though an aperture 12 in the sleeve 5 and past cam 10. This figure corresponds to FIG. 3 of Kluson.

FIG. 3 shows a cross section of the tuning peg 2 and the sleeve 5 in the string clamping position. The tuning peg has been rotated counter-clockwise from the position in FIG. 2 to clamp the string and to pull string 4 in the direction of arrow 11. The string is clamped between the cam 10 and the cross drilled hole or aperture 12 in sleeve 5. This figure corresponds to FIG. 4 of Kluson.

Aperture 12 is preferably tangent to the inside diameter of the sleeve 5, as shown in FIGS. 2 through 6. Notice further that the present invention incorporates only rounded surfaces along the path of the string. In particular and unlike Kluson, there are no sharp surfaces that clamp the string. This feature keeps the string from being sheared off or from being weakened by scoring.

FIG. 4 shows a force diagram in the string, sleeve, and cam. The locking torque LT is the product of the force in the string SF times the outside radius of the sleeve SR. This is expressed in FORTRAN by $$LT=SF*SR$$

The force against the string FAS is the torque LT times the cosecant of the angle T divided by the distance D between the center of the tuning peg and the center of curvature of the cam wherein the angle T is between the line defined by the center of the cam and the center of the tuning peg and a line from the center of the tuning peg perpendicular to the surface of the sleeve which grips the wire. Again in FORTRAN, this is $$FAS=LT*\text{COSEC}(T)/D$$

The lock functions, if the coefficient of friction MS of the string times the normal force, in this case FAS, is greater than the force in the string SF, ie.

$$MS*FAS>SF$$

An expression may now be found for the locking condition of the improved tuning peg:

$$1<MS*(SR/D)*\text{COSEC}(T)$$

The term SR/D multiplies the effectiveness of the cam lock. This term is unique to this string locking device, since other locking devices do not incorporate a sleeve which is torqued by the string tension. In the preferred embodiment, SR=0.180 and D=0.030. This gives a locking multiplier of 6. The advantage of this structure and its multiplier term is the angle T need not be as small as necessary to lock in prior art string or wire locks.

Further and unlike Kluson, the present invention may self lock. The self lock of the string occures when the friction torques resisting the opening TR of the lock exceeds the torques attempting to open the lock TU. FIG. 5 shows the forces and torques involved in the self locking situation. In this case the unlocking torque TU is $$TU=FAS*D*\ \mathrm{SIN}\ (T)$$

The resisting torque TR is function of the peg radius PR and the peg-to-sleeve friction MP:

$$TR=FAS*PR*MP$$

The self-locking condition is then:

$$\mathrm{SIN}\ (T)<(PR/D)*MP$$

The friction is aided by the geometry. The PR/D term which is approximately 4 in the preferred embodiment multiplies the coefficient of friction. Then the amount of self-locking may be controlled by the size of the tuning peg and cam relative to the string. Although self-locking requires manual unlocking of the sleeve 5 when changing strings, self-locking is necessary for tremolo stringed instruments.

A SECOND EMBODIMENT OF THE TUNING PEG IMPROVEMENT

The string changing efforts may be minimized by building into the tuning peg the tool necessary to break the self-lock that is required for tremolo instruments. Simply, it is a lever built onto the sleeve that permits the string changer to rotate the sleeve easily. One possibility of an artistic lever on the sleeve is a tear drop as shown in FIG. 6. The tail 14 of the tear drop provides a lever means for rotating the tear drop about the tuning peg so as to disengage or to engage the cam.

Note further that the tear drop sleeve incorporates a slot aperture 15 for accepting the string in lieu of the cross drilled hole. This embodiment permits the musician sight of the cam and the slot for easy alignment for the insertion of the string. It further permits the easy removal of broken pieces of string.

THE SADDLE EMBODIMENT OF THE STRING LOCK

The abovementioned Smith patent also disclosed that the there should be a minimum distance from the string break point and the string attachment point. This embodiment combines that feature with simplicity of a self-tightening string attachment means that does not require special string terminations.

Referring to FIG. 7 the body of the saddle 20 is equipped with screw 21 for securing it to the bridge as commonly found in the art. The saddle also has a sleeve 22 for clamping string 23 to the saddle assembly and to provide said string a breakpoint. The sleeve is grooved 24 to provide a breakpoint at any position that the sleeve might lock in. The sleeve rotates about a shaft 25 that incorporates a cam as described hereinabove.

FURTHER ENHANCEMENTS OF ALL EMBODIMENTS

The cam surface and the sleeve must grip a string which is quite hard. These surfaces must also be hardened to avoid being indented by the string. Once the cam and sleeve are so distorted they no longer grip the string. Hardening the material will strengthen it so that it will not distort as much and will reliably grip the string. Hardening is accomplished by heat treating the material. Of course, the proper material must be picked because not all materials may be heat treated.

The cam and sleeve may also be etched with acid to provide a matte finish and more importantly provide an excellent high friction surface for gripping the string.

The cam, as illustrated in the figures is cylindrical. Since the inside diameter of the sleeve is also cylindrical, the string is held at two points on opposite sides of the string. This may be improved by turning a shape eccentrically into the tuning machine shaft. This shape maybe simply a vee groove of varying depth. Or more complexly, a groove which varies in radius as it varies in depth. The vee groove provides an extra contact point for a total of three. The radiused groove provides a conforming line contact for even greater distribution of compressive stress. Thus, shaping the surface of the cam provides the cam with two or more contact points. The continuous contact of the radiused groove is made of an infinite number of contact points, also more than two.

The present invention is a cam locking means for the strings of a musical instrument. The cam locking action uses the string tension to tighten the lock with a mechanical advantage. The cam lock may be adapted to the tuning machine or to the bridge and saddle structure. Although one skilled in the art can make variations on the above disclosures, the limits of the present invention are defined by the claims below.

I claim:

1. A string attachment device for a stringed musical instrument comprising:

a shaft, a portion of the exterior surface of said shaft forming a cam having an exterior surface;

a sleeve having an interior surface concentrically adjacent said exterior surface of said cam and an aperture for positioning a string between said exterior surface of said cam and said interior surface of said sleeve; and means for rotating said sleeve and cam relative to each other to grasp said string between said exterior surface of said cam and said interior surface of said sleeve.

2. The string attachment device of claim 1 wherein said sleeve includes a lever for manual locking or unlocking.

3. The string attachment device of claim 1 wherein said sleeve includes a string breakpoint.

4. The string attachment device of claim 1 wherein said shaft is adapted to replace the tuning peg of a tuning machine.

5. A string attachment device according to claim 1, wherein at least the exterior surface of said cam or said interior surface of said sleeve is hardened to improve the reliability of said device.

6. A string attachment device according to claim 1, wherein at least the exterior surface of said cam or said interior surface of said sleeve is etched to improve string gripping ability.

7. The string attachment device of claim 1 wherein said cam is shaped to contact said string at two or more points.

8. The string attachment device of claim 1 wherein said aperture in said sleeve is a slot.

9. A string attachment device according to claim 1, wherein said string engages the exterior surface of said sleeve to rotationally bias said sleeve into a grasping position relative to said cam.

10. A string attachment device according to claim 1, wherein said aperture has an axis transverse to the axis of the portion of the string under tension so that said string engages the exterior of said sleeve.

11. A string attachment device according to claim 1, wherein the axis of said cam is offset relative to the axis of said sleeve.

12. A string attachment device according to claim 11, wherein said rotating means rotates said cam relative to said sleeve and said string.

13. A string attachment device according to claim 12, wherein said sleeve includes a lever for permitting rotation of said sleeve relative to said cam and said string.

14. A string attachment device according to claim 1, wherein said attachment device is a saddle of a stringed musical instrument.

15. A string attachment device according to claim 1, wherein said aperture has a longitudinal surface tangential to said inner surface of said sleeve.

* * * * *